United States Patent [19]

McKee

[11] 4,298,242

[45] Nov. 3, 1981

[54] ELECTRICAL SOCKET CONTACT

[75] Inventor: William H. McKee, West Covina, Calif.

[73] Assignee: TRW Inc., Elk Grove Village, Ill.

[21] Appl. No.: 14,694

[22] Filed: Feb. 23, 1979

[51] Int. Cl.[3] ..... H01R 13/11

[52] U.S. Cl. ..... 339/258 R; 29/884

[58] Field of Search ..... 339/258 R, 258 F, 258 P, 339/258 S, 258 T, 256 SP, 259; 29/629 R, 630 R

[56] References Cited

U.S. PATENT DOCUMENTS

| | | | |
|---|---|---|---|
| 3,768,068 | 10/1973 | Palecek | 339/258 R |
| 3,850,500 | 11/1974 | Cobaugh et al. | 339/258 R |
| 4,002,400 | 1/1977 | Evans | 339/258 R |
| 4,035,049 | 7/1977 | McKee | 339/258 R |

FOREIGN PATENT DOCUMENTS

| | | | |
|---|---|---|---|
| 2000388 | 1/1979 | United Kingdom | 339/258 |

*Primary Examiner*—John McQuade

*Attorney, Agent, or Firm*—Neuman, Williams, Anderson & Olson

[57] ABSTRACT

A multi-sided contact is provided for use in electrical connectors. The contact sides define an open-ended enclosure for receiving a plug pin. Each side has a reverse bend substantially uniformly formed therein whereby the bend portions of the sides define a reduced throat section for effecting desired gripping engagement with the pin periphery received therein. The terminal end of each contact side defines in part a contact flared entrance-end which when inserted in a connector insulator opening effects a desired preload on the throat section as will hereinafter be explained in greater detail.

22 Claims, 8 Drawing Figures

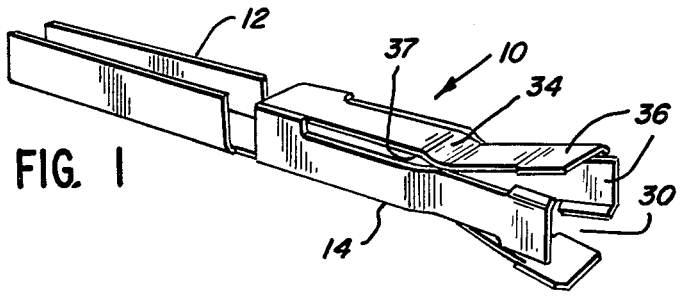
FIG. 1
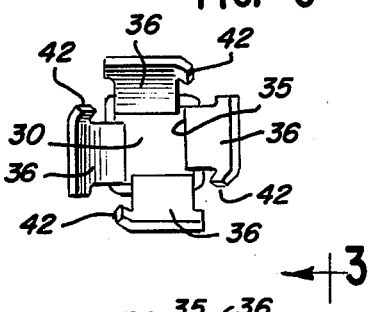
FIG. 3
FIG. 2
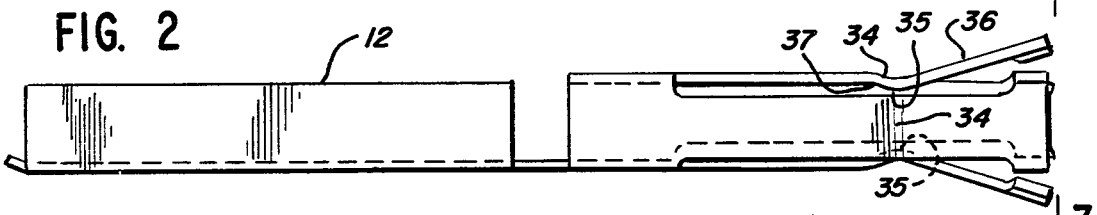
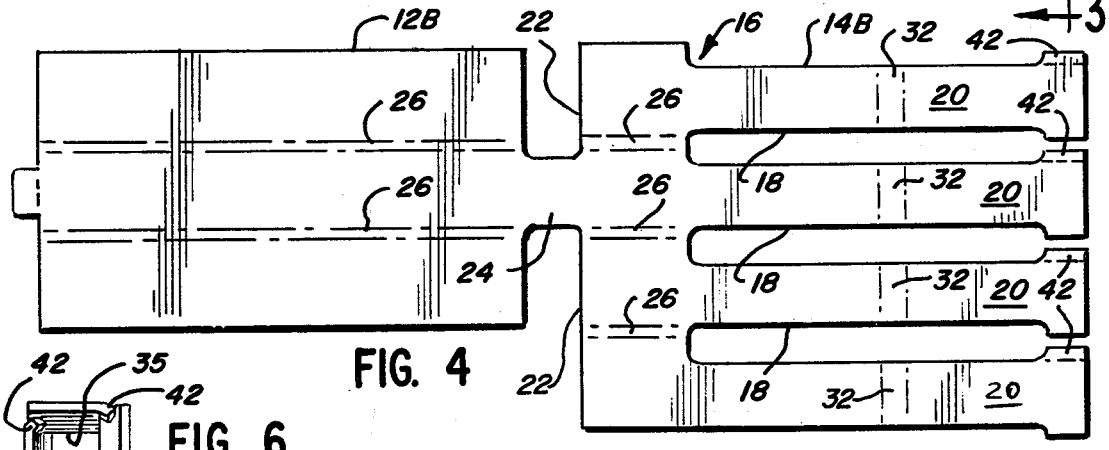
FIG. 4
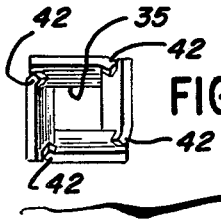
FIG. 6
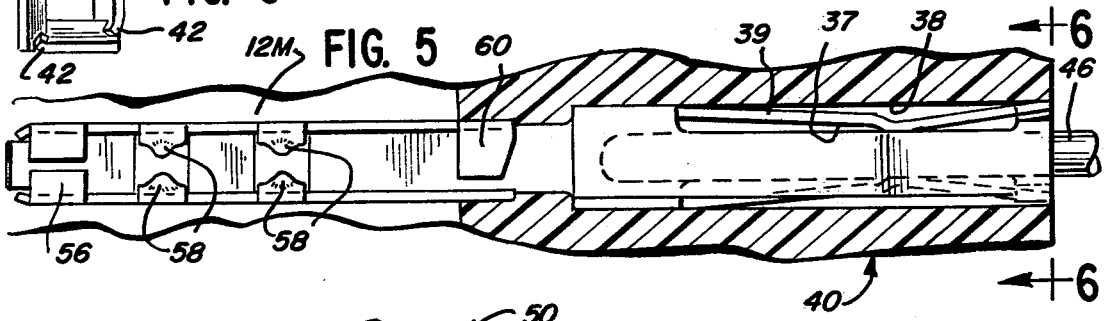
FIG. 5
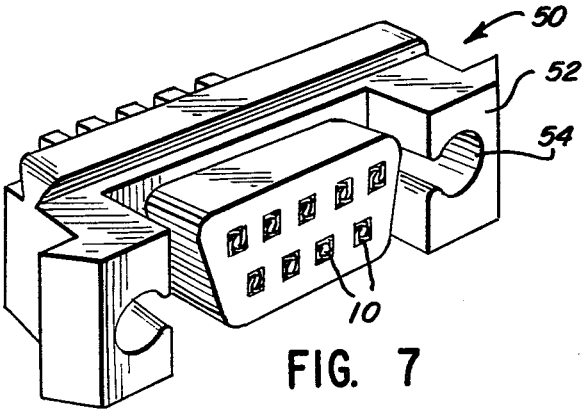
FIG. 7
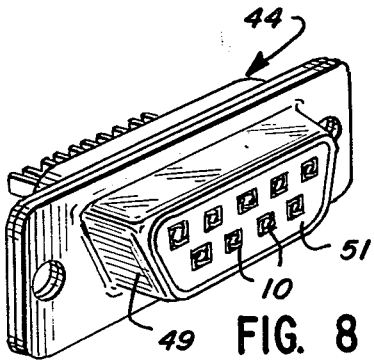
FIG. 8

ELECTRICAL SOCKET CONTACT

This invention relates to an electrical contact, and more particularly pertains to a multi-sided blade contact receivable in a connector receptacle adapted to receive a metal pin contact of a connector plug. The contact engagement establishes electrical communication between conductors terminated in the contacts of mating connectors. Although the use of receptacle-like, multi-sided contacts is known in the art, the provided blade contacts of this invention provide advantages not present in similar type contacts of the prior art.

Thus, four-sided contacts defining an open ended receptacle have been employed in the prior art, being disposed in square openings of connector receptacle insulators. The bladed contacts of the prior art are formed from integral blanks, and each blade or wall thereof is uniformly necked in or bent inwardly toward the central axis of the enclosure so as to define a reduced throat area. The enclosure open end is of adequate sectional area to receive a projecting pin of a connector plug. The necked-in throat area is of such reduced sectional area as to effect a gripping action on the pin periphery inserted through the throat. To enable the blades to be uniformly inwardly bent at the throat area without interfering with one another, the widths thereof were reduced at the throat areas which define the contact area of maximum stress. The dimensional reduction proportionately reduces the pin-gripping forces exerted by the contact blades or walls on the engaged plug pin.

In accordance with the contact of the provided invention a novel multi-sided contact is provided in which the contact walls defining a pin-receiving enclosure are formed from a slotted integral blank as with the prior art. However the blank walls are performed so as to be slightly off-center relative to the central axis of the enclosure formed thereby following a blank-bending step. As a result, each wall may be of its full width where bent inwardly at a central portion to define a pin-engaging throat section. Also, simultaneously with formation of the throat, an open contact end is formed by outwardly flaring wall portions to desired angles. Thus when inserting such contact in a receiving aperture of a connector receptacle insulator, the flared contact ends effect a preload in the contact throat area providing gripping action of desired force on the plug pin received therein.

Thus it is an object of this invention to provide an electrical contact particularly adapted to engage a plug pin with gripping force of desired magnitude. The regulatable gripping force is made possible by virtue of flared ends extending from a pin-engaging throat area formed in each contact.

It is a further object of this invention to provide a novel contact for an electrical connector particularly adapted to engage a mating connector pin in which the walls of such contact defining a pin-receiving receptacle are disposed in off-center relationship with respect to the longitudinal axis of the pin-receiving opening of such contact receptacle. Such relationship enables the full width of the blade walls to be utilized in the area of pin engagement.

It is yet another object of this invention to provide a novel end construction for a contact formed of a plurality of flared wall portions which, upon converging into interengaging relationship, coact to define a rigid periphery about an insulator contact-receiving periphery. Such a novel wall interlock prevents inadvertent positioning of a plug pin behind one of the walls of the contact and an adjacent insulator surface, and thus assures proper reception of a plug pin within the contact.

It is another object of this invention to provide a novel contact for use in electrical connectors in which a double bend is present in each blade-wall portion of such contact adjacent the contact throat area adapted to engage a plug pin. The double bend limits the outward movement of each contact wall or blade if a pin is inserted and tilted while engaged with such contact.

It is yet another object of this invention to provide a simplified method for forming a contact for use in an electrical connector, the contact being readily formed by means of a simple stamping or punching operation followed by a simple bending operation. The bending operation imparts to such contacts the desired pin gripping force when placed in an insulator cavity.

The above and other objects of this invention will become more apparent from the following detailed discussion when read in the light of the accompanying drawings and appended claims.

In one embodiment of the provided invention a contact blank is provided comprising a metal sheet having a plurality of parallel longitudinal slots. The blank may comprise a phosphorous bronze metal sheet of approximately six mils thickness. The slots extend normally from a planar, unapertured transverse band portion and serve to define a plurality of parallel strips or blades which will in turn serve as walls of a box-like receptacle for engaging a contact pin of an electrical connector plug after the blank is predeterminately bent. The blades are arranged in a novel off-center relationship with respect to the central longitudinal axis of a contact-receiving enclosure formed when the transverse band from which the blades extend is bent along axes extending through said formed slots. The blades are also bent along a common transverse axis transversely disposed to the longitudinal axes of the contact strips. Thus, when the blank and transverse band is folded along such axes extending through the blank slots, the four blades or contact walls are disposed in off-center relationship with the central axis of the opening defined by the walls. The end of each of the blades or contact walls diverges from the transverse bent portions so as to provide a flared opening oppositely disposed to a square, box-like portion formed when the transverse blank portion is folded.

Thus, in accordance with the provided invention, the blade-forming slots are formed in the blank so that when folding the blank along axes disposed in the solid transverse band portion, each blade wall is in off-set relationship with respect to the longitudinal axis of the receptacle opening defined by the blades or walls. As a result, a maximum width of material may be retained for each blade when folded in along the throat area for desired gripping action with a plug pin received therein as will hereinafter be explained in greater detail.

By desired angular disposition of the flared end portions of the contact blade walls, the blades may be preloaded when the contact is inserted in a contact-receiving insulator opening. The distal portions of the contact not only effect a gripping action with the insulator, but in addition provide a desired action at the throat area where the four contact walls mutually engage.

For a more complete understanding of this invention reference will now be made to the drawings wherein:

FIG. 1 is a perspective view of a contact made in accordance with the teachings of this invention;

FIG. 2 is a side elevational view of the contact of FIG. 1;

FIG. 3 is an end elevational view taken on line 3—3 of FIG. 2;

FIG. 4 is a plan view of a blank from which the contact of FIGS. 1, 2, 3 is formed;

FIG. 5 is an elevational view of a contact made in accordance with this invention after reception in a contact-receiving opening of an insulator fragmentarily illustrated in FIG. 5 in section and employing a solderless wire-termination system;

FIG. 6 is an end elevational view taken along line 6—6 of FIG. 5;

FIG. 7 is a perspective view of a plastic-body electrical contactor utilizing the contacts of FIGS. 1 through 5;

FIG. 8 is a view similar to FIG. 7 illustrating an electrical connector utilizing the contacts of this invention and employing a metal shell.

Referring now more particularly to FIG. 1 a contact 10 is therein illustrated comprising conductor-terminating portion 12 and a pin-engaging contact portion 14. The contact 10 thus comprises an integral unit adapted to engage a conductor or wire by means of portion 12 and a portion 14 adapted to releasably engage by means of a bayonet-type engagement, a metal contact pin of an electrical connector plug. The invention hereinafter described is concerned with contact portion 14; portion 12 of the contact 10 may be of any structure adapted to engage a conductor in electrical engagement, such as the solderless termination system disclosed in McKee U.S. Pat. No. 4,035,049, illustrated in detail in FIG. 5 of the drawing. The wire or conductor-termination portion 12 of the contact 10 may also comprise any of well-known solder pot, crimp snap-in contact termination systems well-known in the art.

The contact 10 is formed from a blank 16, see FIG. 4, which has been stamped so as to form parallel longitudinal slots 18. Blank 16 is formed of a metal of good electrical conductivity such as a phosphorus-bronze alloy. The slots in turn define four parallel longitudinal blade or contact side portions 20. The four contact blades are contiguous and integrally formed with a solid transverse band portion 22. The blank transverse band portion 22 is also integrally formed with a connecting neck 24 so as to be integrally formed with blank portion 12B from which the contact termination portion 12 of FIG. 1 is formed following bending along the longitudinal axes 26.

In accordance with this invention, slots 18 are stamped out or otherwise formed in blank 16. Such slots are formed in such a manner that when blank 16 is folded along the bend axes 26 disposed in blank portion 12 and portion 22, the central longitudinal axes of walls or blades 20 will be in offset relationship with the central longitudinal axis of the pin-receiving enclosure 30, see FIG. 1, formed by the blade walls 20; the off-center relationship is apparent from end views comprising FIGS. 3 and 6 of the drawing.

Thus, the provided contact differs from the prior art contacts of this type possessing contact blade walls uniformly arranged about the longitudinal axis of the pin-receiving aperture defined by such contact walls. After bending the contact-forming blank in accordance with this invention, by virtue of the offset relationship of the blade walls, after each of the blade walls has been transversely bend along a transverse bend axis 32 so as to form the S-shaped reverse bend portion 34 more clearly seen in FIG. 1 of the drawing, flared end portions 36 of the contact 10 are simultaneously formed as is also apparent from FIG. 1 of the drawing.

By predetermined design of the reverse bend 34 of each of the blade walls 20, the angular disposition of the flared end portions 36 of the contact is determined. The greater the blade or wall divergence from bend 34, the greater the loading of the throat receiving a contact pin in the normal position of contact use. Flared portions 36 will be urged to converge when the contact 10 is inserted in a square insulation contact cavity such as cavity 38 of electrical connector insulator 40 illustrated in FIG. 5.

Laterally and inwardly projecting from each blank blade 20 is a bent ear 42, seen most clearly in FIG. 3. It is the function of these bent ear portions integrally formed with each contact flared blade portion 36 to serve as a stop for an adjacent blade portion 36, preventing the inward movement of each contact blade portion beyond a minimum periphery. As a result of each ear portion serving as a stop for an adjacent contact flared wall portion, the pin-receiving or entrance end of each contact 10 will appear as seen in FIG. 6 of the drawing. These peripheries may be sized slightly larger than that of the receiving insulator.

Thus upon insertion of each box contact 10 formed from blank 16 illustrated in FIG. 4, in an insulator contact cavity, the flared end portions of the blank 16 are converged by the walls of the cavity, each blade flexing inwardly until innermost blade portion 35 thereof engages an edge of an adjacent blade at reverse bend 34 in the manner illustrated in FIG. 6 of the drawing. Such bending of the blade flared ends as the contact blank is inserted within the insulator opening will provide a preload at the contact throat or pin-engaging periphery as above explained. The throat defined by innermost projecting portions 35 of each blade bend 34 is seen most clearly in FIG. 6 of the drawing. The throat is employed for gripping peripheral portions of a contact pin inserted therein such as contact pin 46 illustrated in FIG. 5. Thus in the course of inserting contact 10 in a connector insulator opening, flared blade portions 36 will transform from the appearance of FIG. 3 to that of FIG. 6.

By virtue of the fact that the flared contact wall portions 36 may not move inwardly beyond the position illustrated in FIG. 6, it is impossible for a pin such as pin 46 seen in FIG. 5 to enter behind one of the flared end portions of the contact as the bent blade portions 42 function as stops preventing the four flared blade portions 36 from moving away from the insulator walls.

The prior art contacts necessitated a reduction in contact wall width at the bent, throat-defining portions of the contact walls which would engage an electrical plug pin to prevent mutual interference. Such reduction in width is not necessary with the contact of the provided invention by virtue of the offset relationship of the blades or walls relative to the central longitudinal axis of the receiving aperture 30. As a result, a greater blade width may be retained for stronger, more effective pin-gripping action, and a more secure contact is assured when a plug pin is received in the contact opening at the throat defined by bends 35.

It should also be noted that the double bend at 34 of each contact blade 20 creates not only throat bend 35 but also adjacent, outwardly directed bend 37 seen in FIGS. 2 and 5. Bends 37 minimize over-flexing of a contact wall if a pin such as pin 46 of FIG. 5 is tilted while engaged with the contact 10. The contact blade or wall will flex in the course of such pin pivotal movement until the contact portion bears against the contact cavity wall. The reverse bend portion 37, therefore, reduces the possible wall bending action in the provided contact construction in the course of pin engagement. As a result the danger of the contact 10 assuming a "set" which results in impaired engagement with a pin such as pin 46 of FIG. 5 is minimized.

The provided contacts may be employed in any electrical connector employing box-like contacts of this type including those sold by TRW Inc. of Elk Grove Village, Illinois under the name Cinch D Subminiature Connectors. Thus connector 44 of FIG. 8 illustrates such a D Subminiature Connector employing the contacts of this invention surrounded by metal shell 49. Shell 49 may be of cadmium plated steel and insulator 51 may be formed of an appropriate dielectric such as nylon or diallyl phthalate. The shell is keystone-shaped to polarize conductors in the course of intermating.

Connector 50 of FIG. 7 utilizes an all plastic insulator body which may be of glass-filled polyester or other appropriate plastic in which the metal contacts 10 are mounted. It will be noted from FIG. 7 that such connector 50 may have integrally formed therewith, a plastic latch portion 52 which may, in turn, have a longitudinal opening 54 therein for passage of a screw member in the event that such a screw is desired for engagement purposes with either a mating connector, a hood or a chassis. Latch portion 52 may serve a similar function for latching the illustrated connector 50 to another electrical component mounting component or protective component such as a hood or the like.

As above pointed out the termination portion of the contact 10 may be of a variety of types. By way of illustration, FIG. 5 depicts a solderless termination system of the type disclosed in McKee U.S. Pat. No. 4,035,049 which contact portion 12M may comprise downwardly disposed strain relief tabs 56, folded-over jaw portions 58 adapted to cut through the insulation of a wire to be terminated and locking tab 60 adapted to serve as a means for retaining the contact 10 to insulator 40.

It is believed apparent from the foregoing that the provided contact enables a desired gripping force to be exerted in an engaged pin by desired initial angular disposition of the blade flared portions 36 prior to insertion in an insulator cavity. The novel offset arrangement of applicant's contact walls enables the full wall widths to be retained without narrowing at the throat area. Accordingly, desired contact strength is assured. The novel blade tabs assure a fixed distal contact periphery adjacent the insulator opening periphery and prevents a plug pin from inadvertently being inserted between the insulator cavity wall and an outside blade surface.

Although the foregoing description has been specific with respect to contact 10 having four sides, it is believed apparent that the foregoing structural features are applicable as well to contacts having three or more sides.

The above-discussed contact construction possesses many structural features providing functional advantages as above brought out in detail. The illustrated contacts have been presented by way of example only. This invention, therefore, is to be limited only by the scope of the appended claims.

What is claimed is:

1. An electrical contact comprising a first box-like end and at least three discrete resilient walls extending from said first end; said walls being inwardly bent to form a restrictive throat portion and having portions outwardly flared from said throat portions to define a contact entrance oppositely disposed to said box-like end; each of said wall flared portions being inwardly resiliently movable for urging the wall throat-forming portions together; each of said walls being of a width greater than the width of the throat portion formed thereby and arranged relative to each other at said throat portion so as to extend beyond the edge of one adjacent wall only when said throat forming portions are urged together.

2. The electrical contact of claim 1 in which a distal end portion of each flared wall portion has a lateral projection located so as to function as a stop preventing further inward movement of an adjacent flared wall portion when said flared wall distal portions are urged into a converging relationship.

3. A four sided electrical contact comprising four walls joined at first portions thereof defining an enclosed passageway portion; said walls having second, separated portions connected to said first portions; said second portions being of lesser width than said wall first portions and having reverse bends formed therein defining a throat of lesser sectional area than that of said enclosed passageway portion, and flared contact portions divergently extending from said throat; said second portions being inwardly resiliently movable and arranged in overlapping edge relation about the central longitudinal axis extending from said passageway portion whereby each wall throat-defining portion engages a stop comprising a reverse bend portion of a single adjacent wall only upon converging inward movement of said flared contact portions; such engagement preventing further inward movement.

4. The electrical contact of claim 3 in which each of said reverse bends is contiguous with an outwardly diverging contact wall portion; said diverging wall portions defining a contact entrance for reception of a mating pin or the like.

5. A method for forming an electrical contact of box-like configuration comprising the steps of forming parallel slots in a metal blank so as to define a plurality of flexible wall-forming elements extending from a transverse blank strip, bending said transverse strip along axes extending through said slots in such manner so as to form a box-like enclosure wherein the central longitudinal axis of said elements are arranged in uniformly offset relation relative to the central longitudinal axis of the enclosure formed by said transverse strip, and uniformly bending inwardly said to form an enclosure in which each element engages and extends beyond one corresponding adjacent element edge.

6. The method of claim 5 in combination with the step of bending said wall-forming elements intermediate the ends thereof along transverse axes to form a throat of lesser sectional area than that of said box-like enclosure.

7. The method of claim 5 in which the step of bending said wall-forming elements is effected following formation of said box-like enclosure.

8. The method of claim 5 in which the step of bending said wall-forming elements is effected before formation of said box-like enclosure.

9. An electrical contact blank comprising a plurality of walls joined along parallel bend axes at first portions and separated from each other by means of slots at second portions contiguous with said first portions; said wall second portions having reverse bends disposed therein along transverse axes whereby said wall first portions define an enclosure, said reverse bends of said second portions form a multi-sided throat of lesser sectional area than said enclosure and said second wall portions also define a flared opening extending from said throat when said first wall portions are bent along said bend axes; the central longitudinal axes of said wall first and second portions being uniformly offset from each other; each of the throat sides being formed from a fraction of the widths of each of said second wall portions and being in overlapping edge relation in which each second wall portion extends beyond a corresponding adjacent wall edge.

10. An electrical contact comprising a box-like receptacle having a flared entrance end; at least three discrete contact walls defining said entrance end; bent portions on each of said walls defining a pin-engaging throat of lesser sectional area than said entrance end spaced inwardly thereof; each of said walls bearing against one edge of a first adjacent wall comprising a stop preventing further inward movement of said each wall and each of said walls functioning as a stop for a second adjacent wall preventing further inward movement of said second adjacent wall so as to define a closed periphery at said throat upon urging said walls inwardly, each portion of the throat closed periphery being formed by a portion only of the width of one of said discrete contact walls; and a wire-terminating portion connected to an end of said box-like receptacle oppositely disposed to said flared end.

11. The electrical contact of claim 10 in which means are provided on each of said wall ends for preventing inward movement of the wall ends beyond a minimum periphery defined by the distal ends of said wall flared portions at said entrance end.

12. The electrical contact of claim 11 in which the movement preventing means comprises a laterally and inwardly projecting tab disposed on each of said wall distal ends defining said entrance end which functions as a stop preventing further inward movement of an adjacent wall engaging said tab.

13. The electrical contact of claim 10 in which each of said bent portions in each of said walls comprises an inwardly bent portion defining said throat and a contiguous outwardly extending reverse bend portion.

14. The contact of claim 13 in combination with an electrical connector insulator; said insulator having a contact-receiving aperture of such dimensions as to resiliently urge the throat-defining portions of said contact walls into engagement at said throat by converging said wall portions.

15. The combination of claim 14 in which each of said reverse bend wall portions adjacent the throat-defining portion of each contact wall is disposed adjacent an insulator wall portion defining the contact-receiving aperture whereby flexing of such contact wall portion is minimized upon pivotal movement of a pin disposed in such contact.

16. The contact of claim 13 in combination with an electrical connector insulator; said insulator having a contact-receiving aperture of such dimensions as to urge the distal ends of said walls defining said entrance end into mutual engagement.

17. An electrical contact comprising a flared entrance end formed from a plurality of discrete resilient walls; said resilient walls flaring from a throat portion of said contact of reduced sectional area; and means located on one corresponding edge of each of said resilient walls for stopping resilient inward movement of an adjacent flared wall when said flared walls are urged into converging relationship, portions of said resilient walls defining said throat portion being urged into contact upon urging said flared walls into converging overlapping relationship wherein each resilient wall portion defining said throat portion is of a greater width than the peripheral portion of said throat defined thereby.

18. The electrical contact of claim 17 in combination with an electrical connector insulator; said insulator having a contact receiving aperture in which said contact is disposed; said aperture being of such dimensions as to urge the contact resilient walls defining said flared entrance end into mutual engagement defining a periphery determined by the stopping means disposed on one edge of each resilient wall.

19. An electrical contact comprising at least three electrically conducting walls having first portions defining a first enclosure for reception of a contact pin or the like; said first portions having flexible second wall portions of lesser width joined thereto and which are inwardly formed intermediate the ends thereof to define a multi-sided throat of lesser sectional area than that of said first enclosure; each of said second inwardly formed wall portions having widths greater than the width of the throat side formed thereby; said inwardly formed portions being in an overlapping-edge relation and in an offset relation relative to the central longitudinal axis of said contact first enclosure whereby each of said contact portions defining said throat engages a stop comprising a single adjacent wall portion edge upon uniform flexing of said walls inwardly.

20. In an electrical contact for resiliently engaging peripheral portions of a contact and comprising flexible, discrete, blade-like wall portions having inwardly bent portions defining a contact receiving throat upon inwardly bending said wall portions into mutually abutting engagement, the improvement comprising said wall portions being arranged in a uniform overlapping edge relationship whereby each peripheral portion of said contact-receiving throat is formed of blade-like wall portion having a width greater than that of the throat peripheral portion formed thereby.

21. The electrical contact of claim 20 in which said overlapping relationship comprises each wall portion resiliently bearing against a first adjacent wall portion at said throat and serving as a stop against further inward movement of a second adjacent wall portion.

22. The electrical contact of claims 1, 3, 9, 17, 19 or 20 in combination with a wire terminating portion joined thereto.

* * * * *

UNITED STATES PATENT AND TRADEMARK OFFICE

CERTIFICATE OF CORRECTION

PATENT NO. : 4,298,242

DATED : November 3, 1981

INVENTOR(S) : William H. McKee

It is certified that error appears in the above-identified patent and that said Letters Patent are hereby corrected as shown below:

olumn 3, line 65 after "bending" insert -- of -- olumn 7, line 24 (claim 10) after "end" insert -- and --

Signed and Sealed this

*Eleventh* Day of *September 1984*

[SEAL]

*Attest:*

GERALD J. MOSSINGHOFF

*Attesting Officer*

*Commissioner of Patents and Trademarks*